US006104378A

United States Patent [19]

Burchard et al.

[11] Patent Number: 6,104,378

[45] Date of Patent: Aug. 15, 2000

[54] MANUAL CONTROL DEVICE

[75] Inventors: Thomas Burchard, Pforzheim; Wolfgang Bredow, Birkenfeld; Thamoa Haug, Kieselbronn, all of Germany

[73] Assignee: NBB Nachrichtentechnik GmbH & Co., KG, Olbroon-Durrn, Germany

[21] Appl. No.: 08/716,162

[22] PCT Filed: Mar. 14, 1995

[86] PCT No.: PCT/DE95/00361

§ 371 Date: Sep. 18, 1996

§ 102(e) Date: Sep. 18, 1996

[87] PCT Pub. No.: WO95/25994

PCT Pub. Date: Sep. 28, 1995

[30] Foreign Application Priority Data

Mar. 19, 1994 [DE] Germany ..... 44 09 550

[51] Int. Cl.[7] ..... G09G 5/00

[52] U.S. Cl. ..... 345/156; 345/157; 345/161; 345/162; 74/471 XY; 364/190; 463/38

[58] Field of Search ..... 345/156, 157, 345/161, 162; 364/190; 74/471 XY; 463/38

[56] References Cited

U.S. PATENT DOCUMENTS

| | | | |
|---|---|---|---|
| 3,936,713 | 2/1976 | Hunkar . | |
| 5,134,395 | 7/1992 | Stern | 341/20 |
| 5,179,379 | 1/1993 | Allen et al. . | |

FOREIGN PATENT DOCUMENTS

| | | | |
|---|---|---|---|
| 0 495 280 A1 | 7/1992 | European Pat. Off. | H03M 1/06 |

*Primary Examiner*—Julie Lieu
*Attorney, Agent, or Firm*—Pillsbury Madison & Sutro

[57] ABSTRACT

A manual control device with a control stick (joystick) whose output signal is proportional to the angular deflection of the control stick has transducers that step the output signal in such a way that the manual control device imitates or simulates the switching behavior of a N-stage manual control device. For that purpose, analog or digital electronic means associate with the output signal of the manual control device, depending on its value, one among N different voltage values, whose number and potential difference may be predetermined. The advantages of an analog manual control device (few mechanical components, cheap production) are thus combined with the advantages of a N-stage manual control device (adjustment information for the user, wider field of application in industrial control processes).

4 Claims, 2 Drawing Sheets

| | | | | | | | | |
|---|---|---|---|---|---|---|---|---|
| 0-15 | 1 | 0 | 0 | 0 | 0 | 0 | 0 | 0 |
| 16-31 | 1 | 1 | 0 | 0 | 0 | 0 | 0 | 0 |
| 32-47 | 1 | 1 | 1 | 0 | 0 | 0 | 0 | 0 |
| 48-63 | 1 | 1 | 1 | 1 | 0 | 0 | 0 | 0 |
| 64-79 | 1 | 1 | 1 | 1 | 1 | 0 | 0 | 0 |
| 80-95 | 1 | 1 | 1 | 1 | 1 | 1 | 0 | 0 |
| 96-111 | 1 | 1 | 1 | 1 | 1 | 1 | 1 | 0 |
| 112-127 | 1 | 1 | 1 | 1 | 1 | 1 | 1 | 1 |

MANUAL CONTROL DEVICE

BACKGROUND OF THE INVENTION

The invention relates to a manual control device in accordance with the preamble of claim 1.

Such a manual control device is known from the publication of a German company "Kleinmeisterschalter MO . . . nach Maβblatt M7221, Spohn+Burkhardt, Januar 1991" [Small Master Switches MO . . . in Accordance with Specification Sheet M 7221].

Manual control devices operating in a stepped manner, such as those known from this publication, are equipped with switch elements which are switched on or off as a function of the position of the control stick and by means of that result in the desired stepped characteristic of the control voltage.

Thus, such manual control devices have as a function of the number of steps a relatively large number of on-off switches, for example microswitches, which are actuated by the manual control device on its deflection path. This requires a high manufacturing outlay because of the plurality of error-prone switching elements, which furthermore require a relatively large space and in this way can negatively affect the structural shape of the manual control element.

On the other hand, in connection with many exemplary embodiments, depending on the object to be controlled, such as a crane or other construction apparatus, it is necessary to have discrete voltage values available as control input values for these devices, so that it is not easily possible to do without an appropriate stepping of the control signal for the machine to be controlled.

A manual control device with a control stick is known from DE39 11 171A1, whose angular deflection is converted into a proportional control signal which is interrupted by plateau-like intermediate areas, wherein electronic means are provided by means of which this characteristic of the output signal can be adjusted. These plateau-like intermediate areas are used to eliminate inaccuracies in the positioning of the control stick because of mechanical tolerances, but they do not change the basically proportional switching behavior of this known manual control device to the extent that between these plateaus the control signal extends proportionally with the deflection of the control stick. A stepped characteristic of the control voltage cannot be represented by means of this manual control device, which essentially generates a control signal proportional to the control stick deflection.

U.S. Pat. No. 5,134,395 discloses an interface for the connection of control sticks (joysticks) and switches to the connector Rs232 of a PC, for which purpose an analog-digital converter in particular is employed. As cannot be expected otherwise with an analog/digital conversion, the result of this circuit is that the analog joystick signal is digitized and in this way made available to the downstream connected PC. As with every digitalization, the digitalization necessary for a connection to a PC also causes the conversion of the analog signal of the joystick into an extremely finely "stepped" output signal, whose number of steps inevitably corresponds to the selected resolution or the number of available bits; with the customary 8-bit conversion, the full deflection of the joystick is therefore converted into "bit steps". A pure digitalization is not suitable for the generation of discrete voltage values.

EP-A-0 495 280 also refers to the digitalization of an analog signal for generating a signal in a control circuit which is intended to be used for the compensation of drift appearances of the input signal. If defined permissible values are exceeded, a microcontroller causes a step-like retardation of the dc pre-voltage of a measurement value amplifier. A connection with manual control devices cannot be found in this known complex circuit arrangement.

BRIEF SUMMARY OF THE INVENTION

It is the object of the invention to recite a cost-effective replacement for a stepped electro-mechanical manual control device.

This object is attained in accordance with the invention by means of the characteristics of claim 1.

The essential inventive concept therefore lies in that stepping of the control signal is no longer accomplished directly by means of contact actuation of the control stick along its deflection path, but in a purely electronic way by stepping the analog output signal of an analog operating manual control device, known per se, which for example is equipped with potentiometers, Hall sensors, optical sensors as conversion devices, which convert the angular deflection of the control stick into an electrical output signal which is proportional therewith. The purely electronic conversion is much more cost-effective than the described mechanical-electrical conversion of the control stick movements into stepped control signals and, moreover, also much more reliable. The space requirements for the electronic equipment needed for stepping is minimal, thus it is possible to house the required components freely in the corners of the housing or other unused areas of the housing of the manual control device.

With this variant the electronic components for stepping the manual control device are located in the manual control device itself, therefore already stepped control signals are transmitted to the device or machine to be controlled (as with the manual control device operating in a stepped manner). To this extent the attainment of the object in accordance with the invention represents an "emulation" of a classic manual control device operating in a stepped manner, because the type of generation of the stepped control signals cannot be detected by the controlled device.

But is also possible in the same way to first transmit the proportional output signal to the device to be controlled and to perform stepping there at the input side, which may bring the advantage that it is then possible to match the number of steps and the step width individually to the requirements of the device to be actively controlled.

However, with a digital embodiment in particular, the attainment of the object in accordance with the invention also allows free programming of the electronic stepping components for generating any arbitrary stepping characteristics, so that here considerable savings can be achieved on the manufacturing end in that it is possible to realize the entire spectrum of actually required steps during actual operation by means of a basic type of an analog operating manual control device together with a programmable basic variant of electronic components.

The attainment of the object by means of the invention can also be combined in the simplest manner (for example by means of said programming) with a mechanical grid installed in the manual control device, advantageously in such a way that the step sequence is programmed in such a way that during each step change of the mechanical grid device (for example when passing a grid groove or the like) the electronic transition to the next step of the control voltage also takes place. By means of this it is possible to create the almost complete illusion for the operator that passing of the mechanical grid steps would be the direct cause for the transition to the next higher step of the control signal which is often very much desired for manipulating such manual control devices, since the operator as a rule is not in visual contact with the device to be remotely controlled, for example the crane. A mechanical grid device of the type discussed here above is disclosed in U.S. Pat. No. 5,680,797, which issued on Oct. 28, 1997, reference being particularly made to FIGS. 1 and 2 thereof.

Further embodiments of the invention ensue from the further dependent claims.

BRIEF DESCRIPTION OF SEVERAL VIEWS OF THE DRAWING

An exemplary embodiment of the manual control device in accordance with the invention will be explained in more detail by means of the drawings, in which are shown in.

Figure 1:
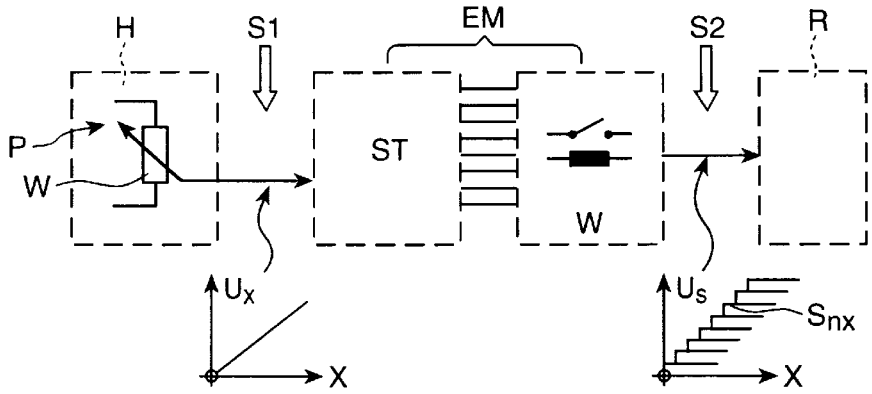
FIG. 1, a block circuit diagram of a radio remote control, using the manual control device in accordance with the invention, FIG. 2, a first variant of the stepping device in accordance with FIG. 1, and FIG. 3, a second variant of the stepping device in accordance with FIG. 1.

All of the drawing figures represent schematic representation in the sense of a basic representation, since the conversion by means of circuit technology of the concept of the invention is possible in many individual embodiments and therefore needs not be explained in detail here.

DETAILED DESCRIPTION OF THE INVENTION

FIG. 1 shows a greatly schematized block circuit diagram of a manual control device H, whose control stick P is represented as a potentiometer to indicate that the output signal $U_x$ emitted by the control stick is proportional to the deflection x of the control stick P. Therefore the potentiometer also constitutes the conversion devices W which convert the deflection x into the electrical output signal $U_x$. It is obvious that this, as well as the following considerations, applies correspondingly to the other coordinate y without this being particularly mentioned.

The control signal $U_x$ is stepped in electronic means EM, so that it is present at the output of these electronic means EM in the form of a stepped output voltage $U_s$ with a number N of discrete voltage values $S_{nx}$; n=1 . . . N, thus the "step structure" represented at bottom right of FIG. 1.

In the exemplary embodiment represented, a receiver R of a remote control installation then receives this stepped output signal and obtains the actual control signals from this, by means of which motors or the like of device to be remotely controlled are then triggered.

The electronic stepping means EM consist of a stepping unit ST and a switching unit W. In the exemplary embodiment represented, it is the job of the stepping unit ST to give to a number N of output lines corresponding to the N discrete voltage values $S_{nx}$of the output signal of the circuit W the required information as to which or, if necessary, how many of a number of N switches (symbolized as relays) are to be closed so that the stepped output voltage $U_s$ assumes the discrete voltage value $S_{nx}$ predetermined by the stepping unit ST. These can be N relays here which are respectively charged with a voltage $U_s$ in correspondence with the discrete voltage values $S_{nx}$ and which are activated by one of the N output lines of the stepping unit ST. But this can also merely be a joining of the output lines of the stepping unit ST with a common control line if the required discrete voltage value $S_{nx}$ has already been made available in the stepping unit as the voltage $U_s$.

In a spatial respect the electronic means EM for stepping can be either disposed at the transmitter location, i.e. associated with the manual control device H, and in this case the transmission path is in the position S2 of FIG. 1, or they can be associated with the receiver R and the radio path is then in the position S1.

Figure 2:
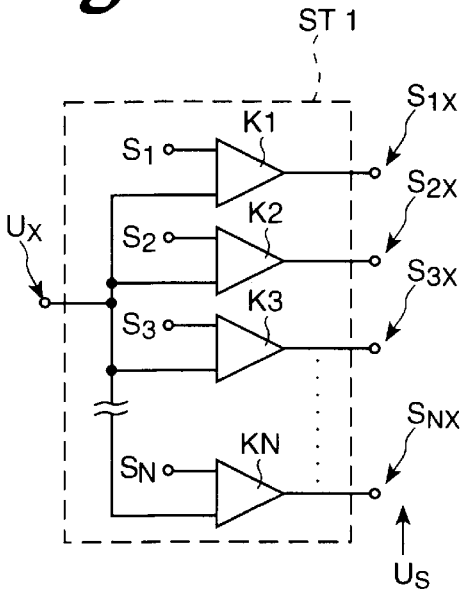

FIG. 2 shows an analog realization of a stepping unit ST1. Here, N comparators K1 . . . KN are connected in parallel, whose comparator input is wired with a respective step value $S_{1x}$ . . . $S_{Nx}$ of the stepped output voltage $U_s$. Each comparator $K_x$ compares the applied proportional value of the input voltage $U_x$ with its predetermined step value $S_{nx}$ and passes this step value $S_{nx}$ on to the output if the value of the voltage $U_x$ lies in a predetermined range $S_{nx}\pm\Delta$. In this case the comparators K1 . . . KN can be designed as discriminators with an upper (S+Δ) and a lower (S−Δ) threshold. As a result, the selected stepped output signal is therefore always present at the output of this analog stepping unit ST1, so that the outputs can be simply combined here.

Figure 3:
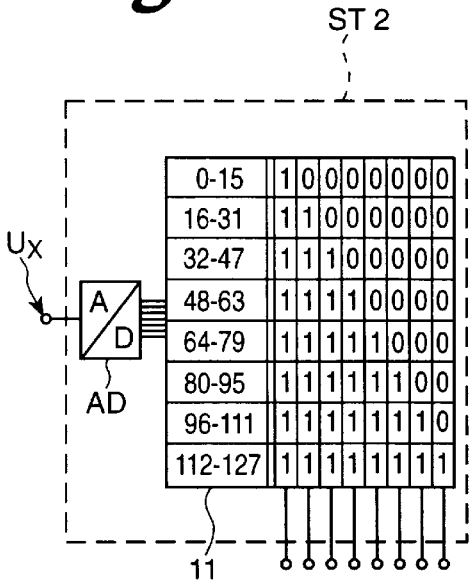
Figure 4:
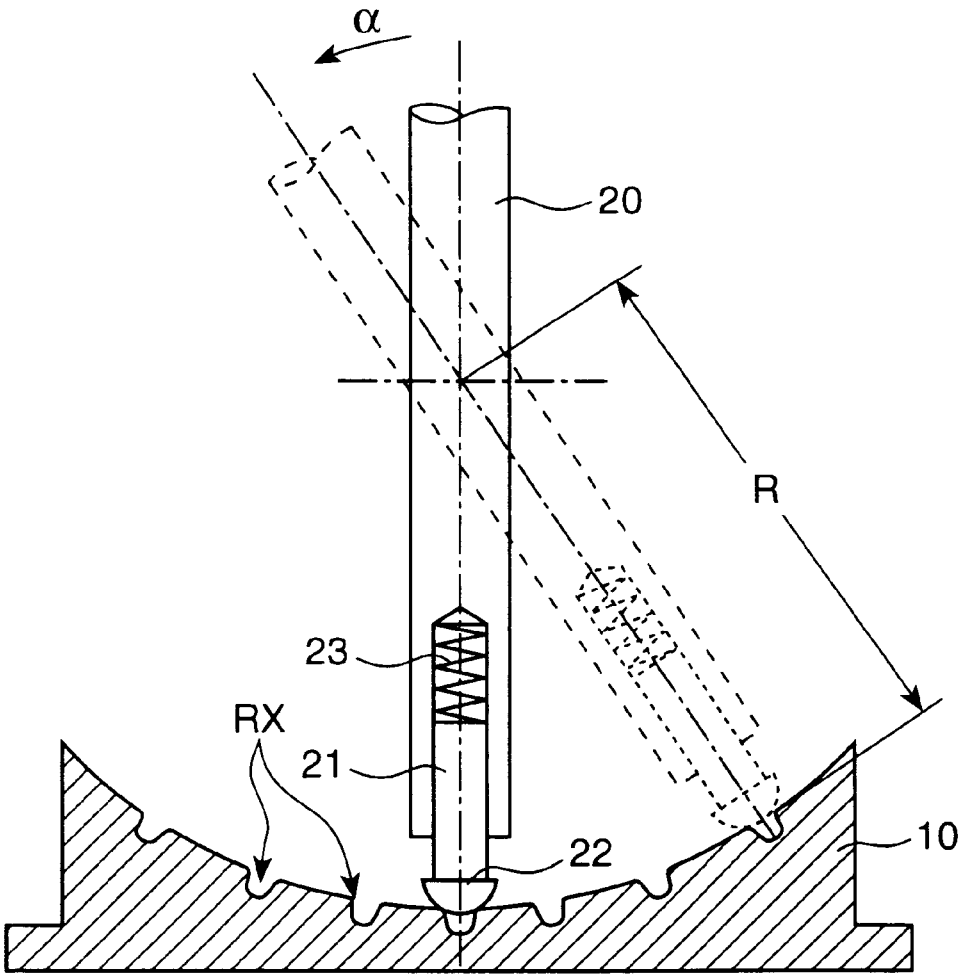
FIG. 4 is an elevational, cross-sectional view of one known embodiment of a portion of a manual control device provided with a mechanical grid.

FIG. 3 shows a digital variant of a stepping unit ST2, wherein the analog signal $U_x$ is initially digitized by means of an analog/digital converter AD; in the exemplary embodiment represented with seven parallel lines and correspondingly parallel 7-bit transmission, the signal $U_x$ is accordingly quantized in 128 steps (0 . . . 127). A memory 11 (EEPROM) is triggered by this signal. In this case the digitized value of the voltage $U_x$ is used as the address of the memory 11. The memory content, shown by way of example, is stored at the storage spaces identified by these addresses with respectively 8 bits, so that upon reading out the memory with a digitized value of the signal $U_x$ of "55", the fourth line with the content "11110000" is read out. This information is then evaluated, for example in the unit W, for generating the associated discrete voltage value $S_{nx}$ of the stepped output signal $U_s$ for example by activating a corresponding number of appropriate relays charged with a voltage.

We claim:

1. A system for converting a manual input into a discrete voltage, the system comprising:

a manual control device including a control stick that is manually deflectable away from a rest position;

conversion means coupled to said control stick for generating an analog voltage ($U_x$) having a value which is proportional to the extent of manual deflection of said control stick away from said rest position; and discrete voltage generating means coupled to said conversion means for deriving, from the analog voltage ($U_x$), an output voltage having a value which is one of N discrete voltage values ($S_{nx}$; n=1 . . . , N), wherein the analog voltage varies over a range of values corresponding to a range of deflections of said control stick away from said rest position, the discrete voltage value of the output voltage is a stepped function of the analog voltage, and said discrete voltage generating means are adjustable for varying the function, whereby said system reproduces the switching behavior of an N-stepped electro-mechanical manual control device equipped with switch elements, wherein variations in the value of the output voltage is synchronized with the step sequence of a mechanical grid device integrated into said manual control device in such a way that when a mechanical grid stage of the grid device is upwardly/downwardly exceeded, a synchronous transition to the next higher or next lower discrete output voltage value takes place.

2. The system in accordance with claim 1 in combination with an N-stepped electro-mechanically operating machine connected to receive, and produce, a mechanical response to, the output voltage.

3. A system for converting a manual input into a discrete voltage, the system comprising:

a manual control device including a control stick that is manually deflectable away from a rest position;

conversion means coupled to said control stick for generating an analog voltage ($U_x$) having a value which is proportional to the extent of manual deflection of said control stick away from said rest position; and discrete voltage generating means coupled to said conversion means for deriving, from the analog voltage ($U_x$), an output voltage having a value which is one of N discrete voltage values ($S_{nx}$; n=1, . . . , N), wherein the analog voltage varies over a range of values corresponding to a range of deflections of said control stick away from said rest position, the discrete voltage value of the output voltage is a stepped function of the analog voltage, and said discrete voltage generating means are adjustable for varying the function, whereby said system reproduces the switching behavior of an N-stepped electro-mechanical manual control device equipped with switch elements, wherein said discrete voltage generating means comprise: a plurality of comparators ($K_l$ . . . $K_N$) each connected to receive the analog voltage, and each of said comparators is a discriminator having an associated upper threshold and lower threshold and producing an output signal representing a respective one of the discrete voltages when the analog voltage has a value between the upper and lower thresholds.

4. The system in accordance with claim 1 wherein said discrete voltage generating means are incorporated physically into said manual control device.

* * * * *